US009731918B2

(12) United States Patent
Lee

(10) Patent No.: US 9,731,918 B2
(45) Date of Patent: Aug. 15, 2017

(54) ROLLER SEPARATION DEVICE AND IMAGE FORMING APPARATUS USING THE SAME

(71) Applicant: Samsung Electronics Co., Ltd., Suwon-si Gyeonggi-do (KR)

(72) Inventor: Byung-jun Lee, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 14/683,374

(22) Filed: Apr. 10, 2015

(65) Prior Publication Data

US 2016/0016741 A1 Jan. 21, 2016

(30) Foreign Application Priority Data

Jul. 18, 2014 (KR) ..... 10-2014-0091318

(51) Int. Cl.
*B65H 5/06* (2006.01)
*B65H 1/12* (2006.01)
(Continued)

(52) U.S. Cl.
CPC ..... *B65H 5/068* (2013.01); *B65H 1/00* (2013.01); *B65H 1/04* (2013.01); *B65H 1/12* (2013.01);
(Continued)

(58) Field of Classification Search
CPC ..... B65H 2404/14; B65H 2404/144; B65H 2404/1451; B65H 5/068; B65H 2511/528
(Continued)

(56) References Cited

U.S. PATENT DOCUMENTS 7,637,501 B2 * 12/2009 Akiyama ..... B65H 5/38 271/273
8,215,636 B2 * 7/2012 Youn ..... B65H 5/062 271/162
(Continued)

FOREIGN PATENT DOCUMENTS

EP 0 383 983 A1 8/1990
EP 2 612 831 A2 7/2013
(Continued)

OTHER PUBLICATIONS

Extended European Search Report mailed Dec. 2, 2015 in European Patent Application No. 15166071.9.

*Primary Examiner* — Patrick Cicchino
(74) *Attorney, Agent, or Firm* — Staas & Halsey LLP

(57) ABSTRACT

An image forming apparatus and roller separation device are provided. The image forming apparatus including a main body having a print unit, a first paper feeding unit containing print paper and insertable in or pullable from the main body, a feed roller in the main body feeding the print paper from the first paper feeding unit to the print unit and comprising a driven roller contacting a driving roller, an elastic member applying an elastic force to the driven roller in a direction to contact the driving roller, a handle member in the main body movable to a first position and a second position, and a separation member connected to the handle member and switched to a normal position separated from the driven roller and a separation position separating the driven roller from the driving roller.

18 Claims, 20 Drawing Sheets

(51) Int. Cl.

| | |
|---|---|
| ***B65H 1/04*** | (2006.01) |
| ***B65H 1/26*** | (2006.01) |
| ***B65H 3/06*** | (2006.01) |
| ***G03G 15/00*** | (2006.01) |
| ***G03G 21/16*** | (2006.01) |
| ***B65H 1/00*** | (2006.01) |

(52) U.S. Cl.
CPC ..... *B65H 1/266* (2013.01); *B65H 3/0684* (2013.01); *G03G 15/6511* (2013.01); *G03G 15/6529* (2013.01); *B65H 2404/1441* (2013.01); *G03G 15/6558* (2013.01); *G03G 21/1638* (2013.01); *G03G 2215/00383* (2013.01); *G03G 2215/00544* (2013.01); *G03G 2215/00679* (2013.01); *G03G 2221/1675* (2013.01)

(58) Field of Classification Search
USPC ..... 271/273–274
See application file for complete search history.

(56) References Cited

U.S. PATENT DOCUMENTS

| | | | | |
|---|---|---|---|---|
| 8,910,940 | B2 * | 12/2014 | Isohara | B65H 5/062 271/242 |
| 2004/0175210 | A1 * | 9/2004 | Otaka | B65H 5/062 399/318 |
| 2006/0083546 | A1 | 4/2006 | Lee | |
| 2007/0031165 | A1 * | 2/2007 | Lee | G03G 21/1638 399/124 |
| 2007/0092294 | A1 | 4/2007 | Jang | |
| 2010/0133739 | A1 * | 6/2010 | Shiraishi | B65H 1/266 271/10.11 |
| 2014/0203503 | A1 * | 7/2014 | Ishikura | G03G 21/16 271/273 |

FOREIGN PATENT DOCUMENTS

| | | |
|---|---|---|
| JP | 7-175360 | 7/1995 |
| JP | 2013-10593 | 1/2013 |
| JP | 2013010593 A * | 1/2013 |

* cited by examiner

ROLLER SEPARATION DEVICE AND IMAGE FORMING APPARATUS USING THE SAME

CROSS-REFERENCE TO RELATED APPLICATIONS

This application is related to, and claims the priority benefit of, Korean Patent Application No. 10-2014-0091318, filed on Jul. 18, 2014, in the Korean Intellectual Property Office, the disclosure of which is incorporated herein in its entirety by reference.

BACKGROUND

1. Field

One or more embodiments of the present inventive concept relate to a roller separation device that may remove a pressing force of a roller for transferring sheets of paper, and an image forming apparatus using the roller separation device.

2. Description of the Related Art

Image forming apparatuses such as printers, copiers, etc. include a print unit for printing an image onto a sheet of paper, a paper feeding unit for supplying a large amount of paper, and a paper transfer unit for supplying sheets of paper from the paper feeding unit to the print unit. The paper transfer unit transfers sheets of paper by using pairs of transfer rollers pressed against each other.

Design of the paper transfer unit takes into consideration many design factors to prevent a paper jam in a process of transferring the paper. However, in spite of such design, a paper jam may occur due to various factors.

When a paper jam occurs, it may be difficult to remove jammed paper because the pair of transfer rollers may be connected to a motor for driving by using a power connection mechanism such as gears. If the jammed paper is forcibly removed, more serious problems may occur as the jammed paper may be torn. In other words, for example, the transfer roller pair may be damaged or the power connection mechanism may be damaged.

When a paper jam occurs, an attempt to remove the jam may be to disconnect the transfer roller pair and the motor to have the transfer roller pair enter an idle state. In this case, an electronic clutch may be required and thus the image forming apparatus may be complicated and expensive.

Another way to attempt to remove the jam may be to remove the pressing force of the transfer roller pair in engagement with an opening operation of a cover that opens a part of the image forming apparatus. In this case, however, since the cover may likely form a part of a paper transfer path, if the cover is connected to an apparatus that removes the pressing force of the transfer roller pair, positional stability of the cover may be degraded and thus the possibility of a paper jam on the paper transfer path may increase.

SUMMARY

One or more embodiments of the present inventive concept include a roller separation device that separates rollers from each other to facilitate removal of jammed paper when a paper jam occurs, and an image forming apparatus using the roller separation device.

Additional aspects will be set forth in part in the description which follows and, in part, will be apparent from the description, or may be learned by practice of the presented embodiments.

According to one or more embodiments of the present inventive concept, an image forming apparatus includes a main body having a print unit, a first paper feeding unit containing a print paper and being insertable in or pullable from the main body, a feed roller provided in the main body and feeding the print paper picked from the first paper feeding unit to the print unit, the feed roller comprising a driven roller and a driving roller contacting each other, an elastic member applying an elastic force to the driven roller in a direction to contact the driving roller, a handle member provided in the main body to be movable to a first position and a second position, and a separation member connected to the handle member and switched to a normal position separated from the driven roller and a separation position to separating the driven roller from the driving roller by pulling the driven roller as the handle member moves to the first position and the second position, respectively.

The handle member may be provided in the main body to be slidable to the first position and the second position, and the separation member may be provided in the main body to be pivotable to the separation position and the normal position.

The separation member may include a pivot shaft, a pull portion to contact the rotation shaft and separate the driven roller from the driving roller as the separation member pivots from the normal position to the separation position, and an accommodation portion on which a rotation shaft of the driven roller is accommodated at the separation position.

The pull portion may include a first end portion and a second end portion having a pivot radius from the pivot shaft that is smaller than that of the first end portion, and a boundary portion having a pivot radius from the pivot shaft that is larger than that of the second end portion may be provided between the pull portion and the accommodation portion.

The pivot shaft of the separation member may be located around a line connecting centers of the driven roller and the driving roller.

An acting line of the elastic force of the elastic member and the pivot shaft may be located on the line.

When the separation member pivots from the normal position to the separation position, an angle between the pull portion and a line perpendicular to a line connecting centers of the driven roller and the driving roller may be equal to or less than 45°.

The image forming apparatus may include a return spring that applies an elastic force to the separation member in a direction in which the separation member is maintained at the normal position.

The image forming apparatus may include a first stopper provided on the separation member, and an excessive rotation prevention portion provided in the main body and contacted by the first stopper when the separation member is located at the separation position.

The image forming apparatus may include a second stopper provided on the handle member, and a movement prevention portion provided in the main body and contacted by the second stopper when the separation member is located at the normal position.

The handle member may be moved from the second position to the first position by an operation of inserting the first paper feeding unit into the main body, and a pressing portion pushing the handle member located at the second position toward the first position when the first paper feed unit is inserted into the main body may be provided on the first paper feeding unit.

A grip portion may be provided on the handle member, the pressing portion may cover the grip portion in a state in which the first paper feeding unit is inserted in the main body, and the grip portion may be exposed to the outside when the first paper feeding unit is pulled from the main body.

The handle member may be moved to the first position and the second position according to the inserting and pulling operations of the first paper feeding unit.

The handle member may pivot to the first position and the second position.

The handle member may be integrally formed with the separation member.

According to one or more embodiments of the present inventive concept, a roller separation device for separating a driven roller from a driving roller includes a holder supporting the driven roller, an elastic member pressing the driven roller in a direction in which the driven roller contacts the driving roller, a handle member supported on the holder to be slidable to a first position and a second position, and a separation member connected to the handle member and supported on the holder to pivot to a normal position separated from the driven roller and a separation position to separate the driven roller from the driving roller by pulling the driven roller as the handle member moves to the first position and the second position.

The separation member may include a pivot shaft, a pull portion to contact the rotation shaft and separate the driven roller from the driving roller as the separation member pivots from the normal position to the separation position, and an accommodation portion on which a rotation shaft of the driven roller is accommodated at the separation position, the pull portion may include a first end portion and a second end portion having a pivot radius from the pivot shaft that is smaller than that of the first end portion, and a boundary portion having a pivot radius from the pivot shaft that is larger than that of the second end portion may be provided between the pull portion and the accommodation portion.

The pivot shaft of the separation member may be located around a line connecting centers of the driven roller and the driving roller.

The roller separation device may include a return spring that applies an elastic force to the separation member in a direction in which the separation member is maintained at the normal position.

The roller separation device may include a first stopper provided on the separation member, an excessive rotation prevention portion provided on the holder and contacted by the first stopper when the separation member is located at the separation position, a second stopper provided on the handle member, and a movement prevention portion provided in the holder and contacted by the second stopper when the separation member is located at the normal position.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
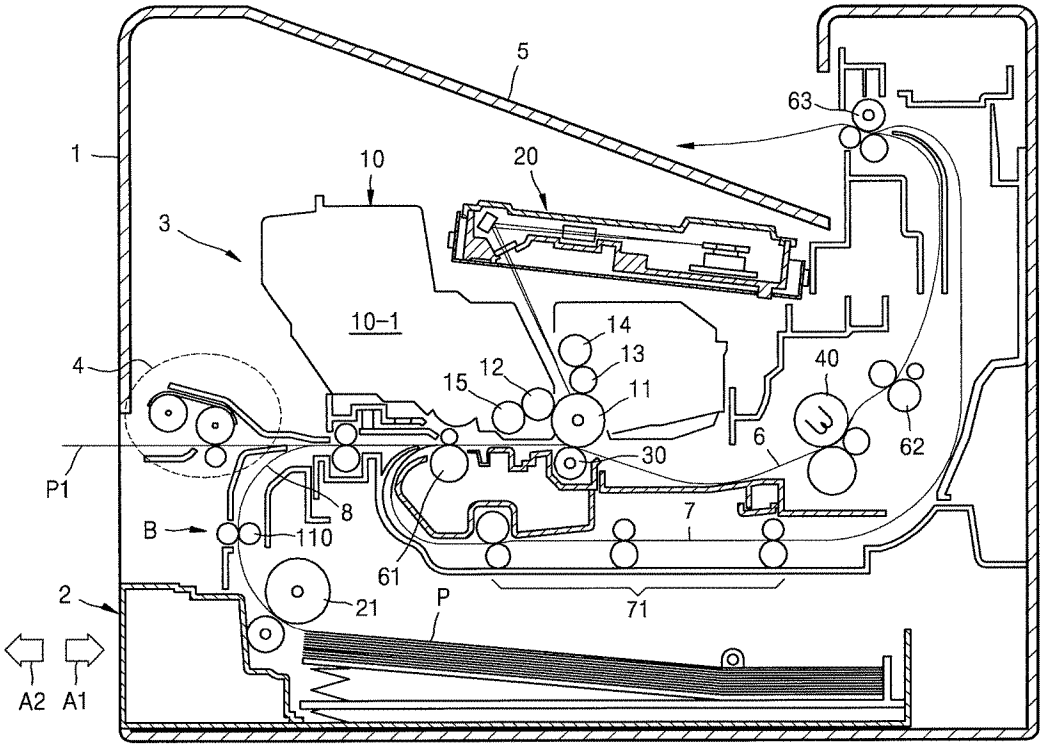
FIG. 1 illustrates an image forming apparatus according to an exemplary embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

FIG. 1 illustrates a structure of an image forming apparatus according to an exemplary embodiment.

Referring to FIG. 1, the image forming apparatus of an exemplary embodiment may include an image forming apparatus main body 1 and a paper feeding cassette (first paper feeding unit) 2 containing sheets of paper (recording medium) P. The image forming apparatus main body 1 includes a print unit 3 to print an image on the paper P supplied from the paper feeding cassette 2. The paper feeding cassette 2 may be detachably provided in the image forming apparatus main body 1 to load the paper P. For example, the paper feeding cassette 2 may be installed in the image forming apparatus main body 1 to be slidable in a direction indicated by arrows A1 and A2. As the paper feeding cassette 2 slides in a direction indicated by an arrow A2, the paper feeding cassette 2 may be pulled from the image forming apparatus main body 1 to be separated, e.g., completely separated from the image forming apparatus main body 1.

The print unit 3 may print an image on the paper P by using a variety of printing methods such as an electrophotographic method, an inkjet method, a thermal transfer method, etc. The print unit 3 of an exemplary embodiment prints an image on the paper P. An example of the print unit 3 that uses a monochromic electrophotographic method is described.

The print unit 3 may include a developing unit 10 to form a toner image corresponding to image information. The developing unit 10 may be detachable from the image forming apparatus main body 1 and may be replaced when a toner contained therein is completely consumed.

A photoconductive drum 11, as an example of a photoconductor having a surface on which an electrostatic latent image is formed, may include a conductive metal pipe and a photoconductive layer formed on an outer circumference of the conductive metal pipe. Although it is not illustrated in FIG. 1, a photoconductive belt may be used instead of the photoconductive drum 11.

A charge roller 13 is an example of a charger that charges the photoconductive drum 11 to have a uniform surface electric potential. A charge brush, a corona charger, etc. may be used instead of the charge roller 13. A cleaning roller 14 removes foreign materials adhering on a surface of the charge roller 13. Although it is not illustrated, a cleaning unit for removing the toner and foreign materials remaining on the surface of the photoconductive drum 11 after a transfer process described later, may be provided. For example, a cleaning blade contacting the surface of the photoconductive drum 11, a rotary brush for rotating and removing the foreign materials from the surface of the photoconductive drum 11, etc. may be used as the cleaning unit.

A developing roller 12 may develop the electrostatic latent image formed on the photoconductive drum 11 into a visible toner image by providing the toner accommodated in a toner accommodation unit 10-1 to the electrostatic latent image. A developing bias voltage to supply the toner to the photoconductive drum 11 may be applied to the developing roller 12. A supply roller 15 supplies the toner of the toner accommodation unit 10-1 the developing roller 12. A supply bias voltage may be applied to the supply roller 15.

A development method includes a one-component development method using a toner and a two-component development method using a toner and a carrier. The one-component development method may be divided into a contact development method in which the developing roller 12 and the photoconductive drum 11 rotate in contact with each other and a non-contact development method in which the developing roller 12 and the photoconductive drum 11 are separated from each other by about tens to hundreds of microns.

When the two-component development method is used, the developing roller 12 is separated from the photoconductive drum 11 by about tens to hundreds of microns. Although it is not illustrated, the developing roller 12 may have a shape that a magnetic roller is arranged in a hollow cylindrical sleeve. The toner is attached on a surface of a magnetic carrier. The magnetic carrier may be attached on a surface of the developing roller 12 and carried to a development area where the photoconductive drum 11 and the developing roller 12 face each other. The toner may be supplied to the photoconductive drum 11 by a development bias voltage applied between the developing roller 12 and the photoconductive drum 11 and thus the electrostatic latent image formed on the surface of the photoconductive drum 11 is developed into a visible toner image.

The print unit 3 of an exemplary embodiment employs a one-component contact development method. Although it is not illustrated, a transfer member for transferring the toner of the toner accommodation unit 10-1 toward the supply roller 15 may be arranged in the developing unit 10. The transfer member may have a variety of shapes such as a paddle, an auger, etc. A restriction member (not shown) for restricting an amount of the toner supplied to the development area between the photoconductive drum 11 and the developing roller 12 by the developing roller 12 may be provided in the developing unit 10. The restriction member may be, for example, a doctor blade that elastically contacts the surface of the developing roller 12.

An exposure unit 20 forms the electrostatic latent image on the photoconductive drum 11 by irradiating light modulated corresponding to image information toward the photoconductive drum 11. A laser scanning unit (LSU) using a laser diode as a light source, a light emitting diode (LED) exposure unit using an LED as a light source, etc. may be used as the exposure unit 20.

A transfer roller 30 is an example of a transfer unit that transfers a toner image from the photoconductive drum 11 to the paper P. A transfer bias voltage to transfer the toner image to the paper P may be applied to the transfer roller 30. A corona transfer unit or a pin scorotron type transfer unit may be used instead of the transfer roller 30.

The paper P may be picked up, for example, one by one by a pickup roller 21 from the paper feeding cassette 2 and is transferred to an area where the photoconductive drum 11 and the transfer roller 30 face each other.

A fuser 40 fixes the toner image on the paper P by applying heat and pressure to the image on the paper P. The paper P that has passed through the fuser 40 is ejected to an exit tray 5.

According to an exemplary embodiment, the exposure unit 20 forms the electrostatic latent image by scanning a light beam modulated corresponding to the image information onto the photoconductive drum 11. The developing roller 12 forms the visible toner image on the surface of by the photoconductive drum 11 by supplying the toner to the electrostatic latent image. The paper P loaded in the paper feeding cassette 2 may be transferred to the area where the photoconductive drum 11 and the transfer roller 30 face each other. The toner image may be transferred to the paper P from the photoconductive drum 11 by the transfer bias voltage applied to the transfer roller 30. When the paper P passes through the fuser 40, the toner image may be fixed on the paper P by heat and pressure. The paper P with the completed fixed image may be ejected to the exit tray 5.

The paper P picked up from the paper feeding cassette 2 may be transferred along a print path 6, and the print unit 3 prints an image on the paper P. A plurality of paper transfer rollers to transfer the paper P may be arranged along the print path 6. For example, the paper P picked up from the paper feeding cassette 2 by the pickup roller 21 may be supplied to the print path 6 by a feed roller 110. Referring to FIG. 1, the paper feeding cassette 2 is connected to the print path 6 by the paper feed path 8. The paper P picked up from the paper feeding cassette 2 is supplied to the print path 6 after passing through the paper feed path 8. The feed roller 110 may be arranged along the paper feed path 8. A registration roller 61 may be arranged at an upstream side of the area (transfer area) where the photoconductive drum 11 and the transfer roller 30 face each other. The registration roller 61 acts as a reference roller for paper transfer. A leading end of the paper P supplied from the paper feeding cassette 2 may be registered by the registration roller 61. The registration roller 61 transfers the paper P that is registered, in time to when a leading end of the toner image formed on the photoconductive drum 11 arrives at the transfer area. The paper P that has passed through the fuser 40 may be transferred toward an exit roller 63 by a transfer roller 62.

A reverse path 7 for duplex printing may be provided in the image forming apparatus main body 1. The reverse path 7 is a path for supplying the paper P back to the print path 6 by flipping the paper P having an image printed on one surface of which while passing through the print path 6. A plurality of transfer rollers 71 to transfer the paper P may be arranged on the reverse path 7. The exit roller 63 may be reversely rotated in a state in which a trailing end of the paper P is held by the exit roller 63 before the paper P having passed through the print path 6 is completely ejected to the exit tray 5. The paper P is transferred along the reverse path 7 and supplied back to the print path 6. The paper P that is reversed passes through the transfer area with a rear surface of the paper P facing the photoconductive drum 11. An image may be printed on the rear surface, and the paper P passes through the fuser 40 and may be ejected by the exit roller 63 to the exit tray 5.

A multipurpose tray (second paper feeding unit) 4 may be used to supply sheets of paper P1 having various regular/irregular sizes to the print unit 3 and may be arranged at a downstream side of the feed roller 110. The paper P1 supplied by the multipurpose tray 4 may be supplied to the print path 6 without passing through the feed roller 110.

Figure 2:
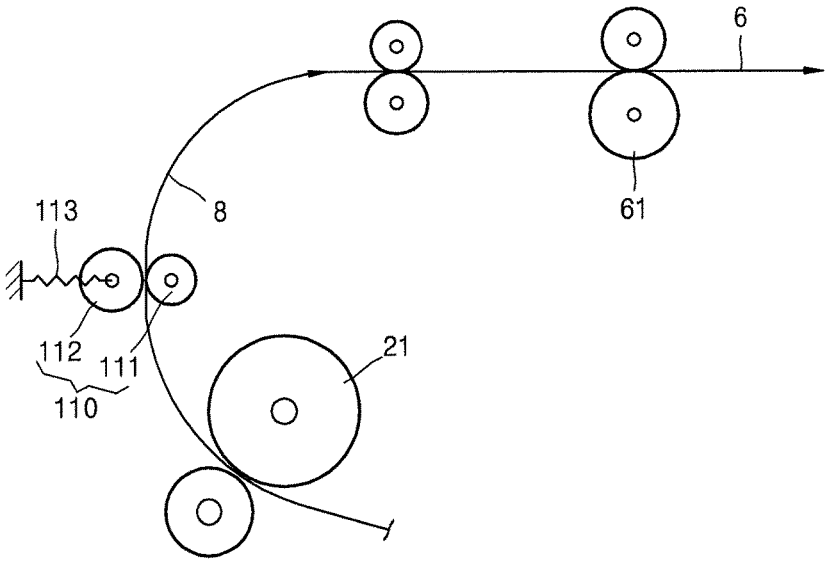
FIG. 2 illustrates an exemplary paper transfer path of a portion B of FIG. 1.

FIG. 2 is a schematic view of a paper transfer path of a portion B of FIG. 1. Referring to FIG. 2, the paper feeding cassette 2 may be arranged under the print unit 3. To restrict an increase in the height of the image forming apparatus, the paper feed path 8 may be bent, e.g., sharply bent in an almost "C" shape and thus a paper jam may be highly likely to occur in the paper feed path 8. Even when a paper jam occurs in the print path 6, a part of the paper P may exist on the paper feed path 8. The feed roller 110 may include a pair of rollers 111 and 112 pressed against each other. The roller 111 may be a driving roller and the roller 112 may be a driven roller. An elastic member 113 presses the driven roller 112 toward the driving roller 111. To easily remove a jammed paper, the driven roller 112 may be separated from the driving roller 111 by moving the driven roller 112 in a direction opposite to a direction in which an elastic force of the elastic member 113 may be applied. A roller separation device for separating the driven roller 112 from the driving roller 111 may be provided in the image forming apparatus of an exemplary embodiment.

Figure 3:
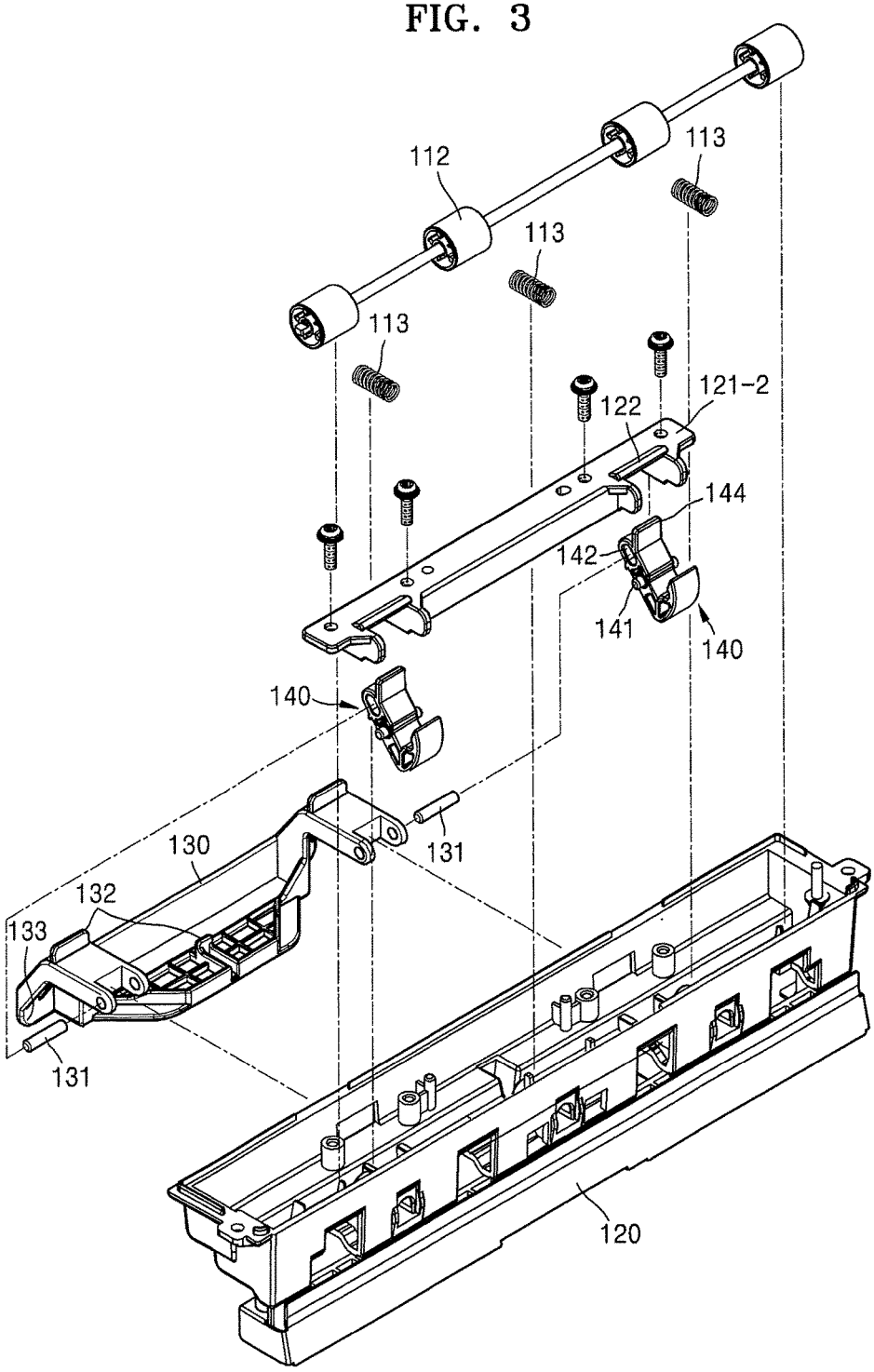
FIG. 3 illustrates a roller separation device according to an exemplary embodiment.
Figure 4:
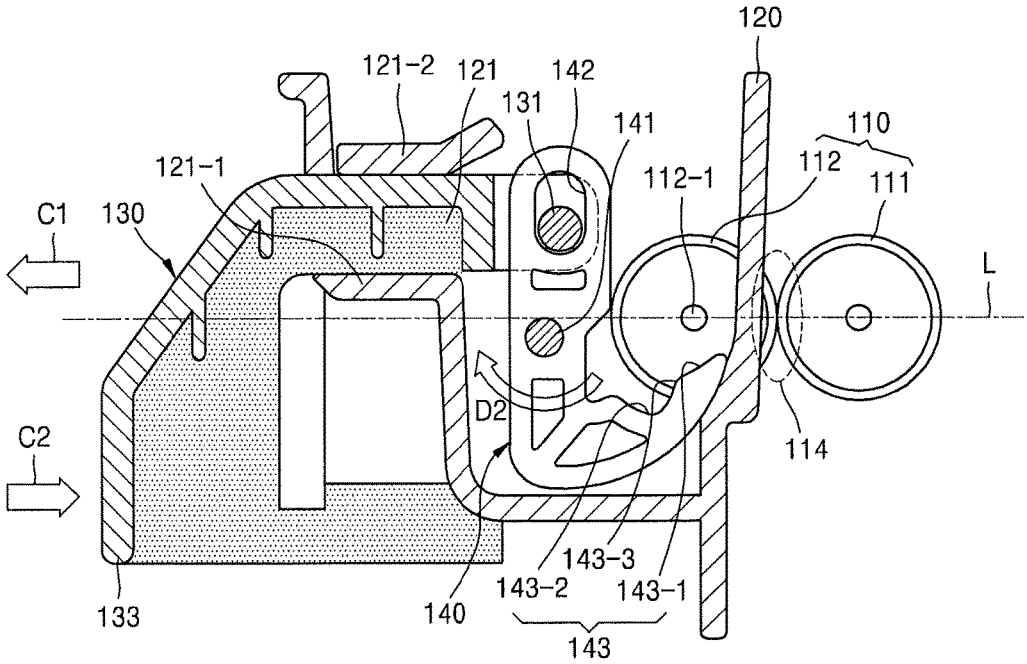
FIGS. 4 and 5 illustrate a roller separation device according to an exemplary embodiment.
Figure 5:
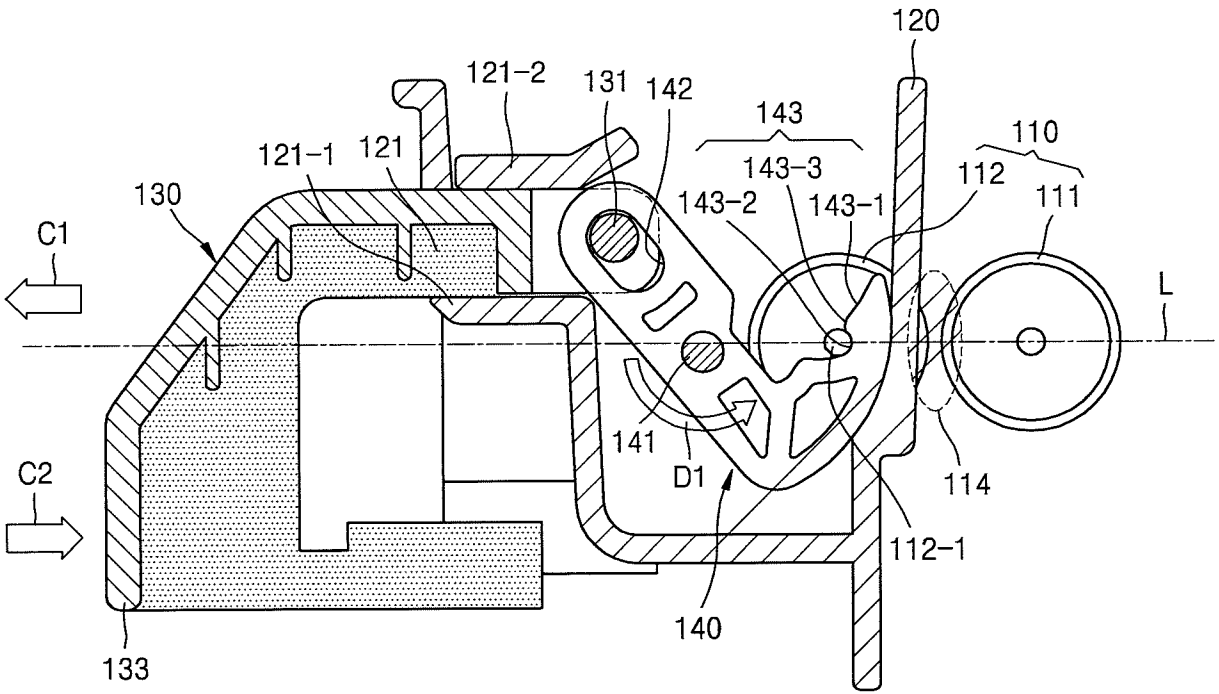

FIG. 3 is an exploded perspective view of a roller separation device according to an exemplary embodiment. FIGS. 4 and 5 are cross-sectional views of an exemplary roller separation device of FIG. 3.

Referring to FIGS. 3 to 5, the driven roller 112, a separation member 140, a handle member 130, and a holder 120 supporting these elements are illustrated. The driven roller 112 may be rotatably supported on the holder 120. The driven roller 112 supported on the holder 120 may move in a direction to contact/be separated from the driving roller 111. The elastic member 113 applies to the driven roller 112 an elastic force in a direction to contact the driving roller 111. For example, the elastic member 113 may be a compressed coil spring having one end portion supported on the holder 120 and the other end portion supported on a rotation axis 112-1 of the driven roller 112.

The separation member 140 may be switched from an exemplary normal position illustrated in FIG. 4 to an exemplary separation position illustrated in FIG. 5. The separation position is a position of the driven roller 112 separated from the driving roller 111 by the separation member 140 that pulls the driven roller 112 in a direction opposite to the direction in which the elastic force of the elastic member 113 is applied. At the normal position, the separation member 140 does not interfere with the driven roller 112. For example, the separation member 140 may be installed in the holder 120 to be able to pivot between the normal position and the separation position.

The handle member 130 may be connected to the separation member 140 to operate the separation member 140. For example, the handle member 130 may be slidably installed in the holder 120. The handle member 130 may be slidably supported on a rail 121 including a lower rail 121-1 and an upper rail 121-2 that may be separated from the lower rail 121-1. The handle member 130 may slide to a first position and a second position respectively corresponding to the normal position and the separation position of the separation member 140.

The separation member 140 may include a pivot shaft 141 supported on the holder 120 to function as a pivot center, a first connection portion 142 connected to the handle member 130, and a hook portion 143 caught by the rotation shaft 112-1 of the driven roller 112. When the separation member 140 pivots to the separation position, and a pivot trajectory of the hook portion 143 intrudes into the paper feed path 8, that is, the pivot trajectory of the hook portion 143 goes beyond a contact portion 114 where the driven roller 112 and the driving roller 111 contact each other, the hook portion 143 may interfere with the jammed paper on the paper feed path 8 to prevent the separation member 140 from moving to the separation position. Furthermore, the jammed paper may be torn apart by the hook portion 143 so that removing the jammed paper may become more difficult. Thus, the position of the pivot shaft 141 may be determined such that the pivot trajectory of the hook portion 143 of the separation member 140 does not go beyond the contact portion 114.

According to an exemplary embodiment, the pivot shaft 141 may be arranged at the side of the driven roller 112 with respect to the contact portion 114 to be spaced apart from the contact portion 114 farther than the rotation shaft 112-1 of the driven roller 112. The pivot shaft 141 may be arranged around a line L connecting the centers of the driven roller 112 and the driving roller 111. When the pivot shaft 141 is excessively separated from the line L, the pivot trajectory of the hook portion 143 increases so that the hook portion 143 may go over the contact portion 114. For example, the pivot shaft 141 may be located on the line L.

A second connection portion 131 of the handle member 130 may be connected to the first connection portion 142. For example, the first connection portion 142 may have a shape of a slot and the second connection portion 131 may have a shape of a protrusion inserted in the slot. The first and second connection portions 142 and 131 convert a sliding motion of the handle member 130 to a pivot motion of the separation member 140. Although it is not illustrated, the first connection portion 142 may have a shape of a protrusion and the second connection portion 131 may have a shape of a slot. The length of the slot may be determined such that the pivot motion of the separation member 140 is available.

Figure 6:
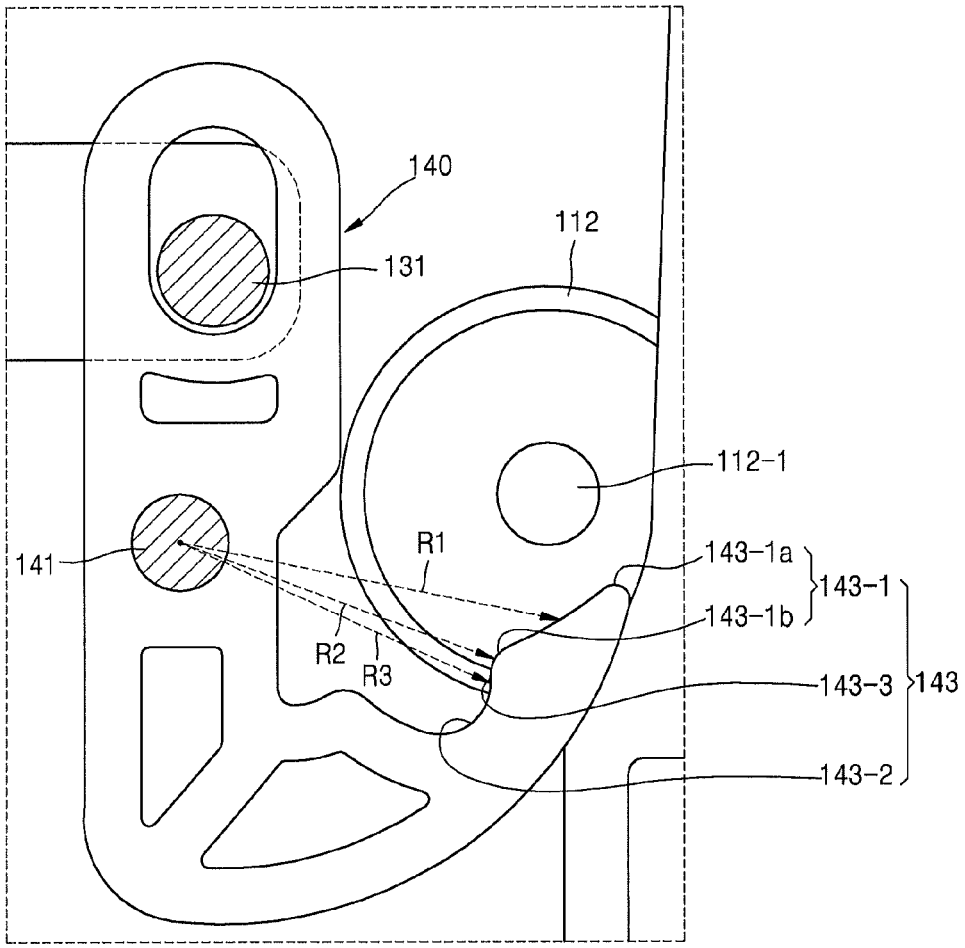
FIG. 6 illustrates an exemplary a hook portion.

FIG. 6 is a detailed view of an exemplary hook portion 143. Referring to FIG. 6, the hook portion 143 may include a pull portion 143-1 that contacts the rotation shaft 112-1 of the driven roller 112 and pulls the rotation shaft 112-1 in the direction opposite to the direction in which the elastic force of the elastic member 113 is applied, as the separation member 140 pivots to the separation position, and an accommodation portion 143-2 on which the rotation shaft 112-1 of the driven roller 112 is accommodated when the separation member 140 is located at the separation position. The pull portion 143-1 may have a shape of a flat surface or a curved surface so that a pivot radius from the pivot shaft 141 gradually decreases. In other words, a pivot radius R1 of the pull portion 143-1 gradually decreases from a first end portion 143-1*a* to a second end portion 143-1*b*. Thus, as the separation member 140 pivots from the normal position to the separation position, the pull portion 143-1 pulls the rotation shaft 112-1 of the driven roller 112 toward the pivot shaft 141. Accordingly, the driven roller 112 may be separated from the driving roller 111.

Since the driven roller 112 and the separation member 140 are disposed inside the image forming apparatus main body 1, it may be difficult for a user to visually check whether the separation member 140 arrives at the separation position. The roller separation device according to an exemplary embodiment has a structure which enables a user to manually recognize whether the separation member 140 arrives at the separation position. In an example, a boundary portion 143-3 may be provided between the accommodation portion 143-2 and the pull portion 143-1. A pivot radius R3 of the boundary portion 143-3 from the pivot shaft 141 may be greater than a pivot radius R2 of a second end portion 143-1*b* of the pull portion 143-1. Accordingly, when the separation member 140 pivots to the separation position, the contact between the rotation shaft 112-1 of the driven roller 112 and the pull portion 143-1 ends, and as the boundary portion 143-3 contacts the rotation shaft 112-1, the driven roller 112 may be slightly moved close to the driving roller 111 by the elastic force of the elastic member 113. In doing so, an impact (a sense of click) is transferred to the user via the separation member 140 and the handle member 130. As a result, the user may manually recognize whether the separation member 140 arrives at the separation position.

A process of removing a jammed paper is described.

When a paper jam occurs, an operation of the image forming apparatus may be stopped. The image forming apparatus may output a paper jam message through a user interlace that is not illustrated. For example, the paper jam message may be output through a display (not shown) or output as an audible signal through a sound output device such as a buzzer or as a visible signal through a light emitting device such as a light emitting diode (LED).

The handle member 130 and the separation member 140 maybe respectively located at the first position and the normal position, as illustrated in FIG. 4. The driven roller 112 and the driving roller 111 maybe pressed to each other. In this state, as illustrated in FIG. 5, a user pulls a grip portion 133 of the handle member 130 exposed to the outside of the image forming apparatus main body 1 in a direction indicated by an arrow C1. The first and second connection portions 142 and 131 convert the sliding motion of the handle member 130 to the rotation motion of the separation member 140, and thus the separation member 140 pivots in a direction indicated by an arrow D1 in FIG. 5. As the separation member 140 pivots in the direction D1, the pull portion 143-1 contacts the rotation shaft 112-1 of the driven roller 112.

Figure 7:
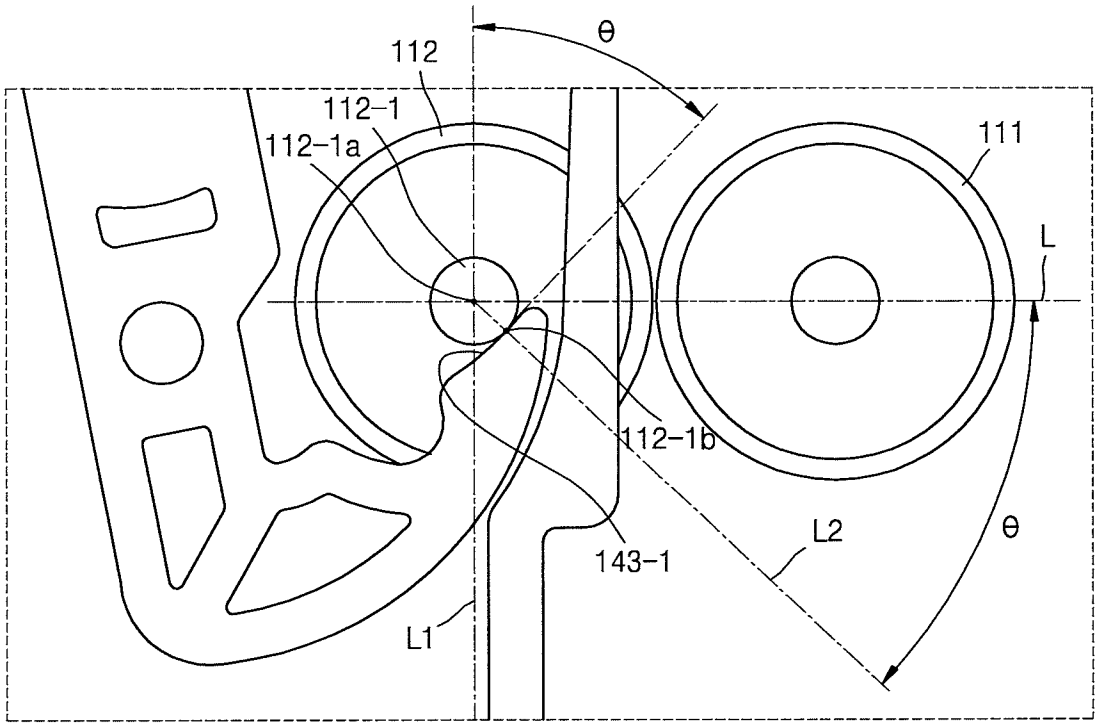
FIG. 7 illustrates an exemplary pull portion contacting a rotational shaft of a driven roller.

FIG. 7 is a cross-sectional view of an exemplary pull portion 143-1 contacting the rotational shaft 112-1 of the driven roller 112. Referring to FIG. 7, when the pull portion 143-1 contacts the rotation shaft 112-1 of the driven roller 112, an entrance angle θ of the pull portion 143-1 with respect to the rotation shaft 112-1 may be equal to or less than about 45°. The entrance angle θ may be defined as an angle between a line L1 that is perpendicular to the line L and passing through the center 112-1*a* of the rotation shaft 112-1, and the pull portion 143-1. In another expression, the entrance angle θ may be defined as an angle between a line L2 that connects a contact point 112-1*b* between the rotation shaft 112-1 and the pull portion 143-1 and the center 112-1*a* of the rotation shaft 112-1, and the line L. Accordingly, since a component force in a direction along the line L of a rotation force of the separation member 140 applied to the rotation shaft 112-1, that is, a component force in a direction opposite to the direction in which the elastic force of the elastic member 113 is applied, may be increased, the driven roller 112 may be easily separated from the driving roller 111 with a relatively small force to operate the handle member 130.

In the state illustrated in FIG. 7, when the separation member 140 pivots in the direction D1 of FIG. 5 by pulling the handle member 130, the contact between the rotation shaft 112-1 and the pull portion 143-1 ends and then the rotation shaft 112-1 contacts the boundary portion 143-3. Since the pivot radius R3 of the boundary portion 143-3 is greater than the pivot radius R2 of the second end portion 143-1*b* of the pull portion 143-1, when a contact state with the pull portion 143-1 is converted to a contact state with the boundary portion 143-3, the driven roller 112 may be slightly moved toward the driving roller 111 by the elastic force of the elastic member 113. In doing so, an impact may be generated and transferred, for example, to the user's hand through the separation member 140 and the handle member 130. The user may recognize that the separation member 140 arrives at the separation position, and, for example, then removes the force pulling the handle member 130. The handle member 130 and the separation member 140, as illustrated in FIG. 5, respectively arrive at the second position and the separation position, and the rotation shaft 112-1 of the driven roller 112 is accommodated on the accommodation portion 143-2.

Since the elastic force of the elastic member 113 pushes the driven roller 112 toward the driving roller 111, the elastic force acts as a rotation force to pivot the separation member 140 to the normal position. However, since the rotation shaft 112 may be accommodated on the accommodation portion 143-2 and the pivot radius R3 of the boundary portion 143-3 may be greater than the pivot radius R1 of the pull portion 143-1, the rotation shaft 112 is difficult to escape from the accommodation portion 143-2. In other words, the boundary portion 143-3 acts as a return prevention portion that prevents the separation member 140 from being returned from the separation position to the normal position. Accordingly, the separation member 140 may be maintained at the separation position and the driven roller 112 may be maintained in a state of being separated from the driving roller 11.

As the pivot shaft 141 of the separation member 140 may be closer to an acting line of the elastic force of the elastic member 113, the separation member 140 may be more stably maintained at the separation position. When the pivot shaft 141 of the separation member 140 may be located on the acting line of the elastic force of the elastic member 113, the separation member 140 may be quite stably maintained at the separation position. When the acting line of the elastic force of the elastic member 113 and the pivot shaft 141 of the separation member 140 are located on the line L, the separation member 140 may be most stably maintained at the separation position.

When the handle member 130 is pushed in a direction indicted by an arrow C2 in the state illustrated in FIG. 5 after the jammed paper is removed, the sliding motion of the handle member 130 is converted to the pivot motion of the separation member 140 by the first and second connection portions 142 and 131 so that the separation member 140 pivots in a direction indicated by an arrow D2 in FIG. 4. As the rotation shaft 112-1 escapes from the accommodation portion 143-2, the driven roller 112 is moved by the elastic force of the elastic member 113 toward the driving roller 111 so as to contact the driving roller 112. When the handle member 130 is completely pushed into the image forming apparatus main body 1, the handle member 130 and the separation member 140, respectively, arrive at the first position and the normal position illustrated in FIG. 4.

Since the feed roller 110 may be arranged adjacent to the paper feeding cassette 2, a method may be considered in which the driven roller 112 may be separated from the driving roller 111 in engagement with an operation of pulling the paper feeding cassette 2 from the image forming apparatus main body 1 by connecting the paper feeding cassette 2 to the driven roller 112, and the driven roller 112 may be contacted with the driving roller 111 by an operation of pushing the paper feeding cassette 2 into the image forming apparatus main body 1. In this case, since the elastic force of the elastic member 113 is applied to the paper feeding cassette 2, when the paper feeding cassette 2 is installed in the image forming apparatus main body 1 and the driven roller 112 contacts the driving roller 111, the elastic force of the elastic member 113 acts in a direction of pushing the paper feeding cassette 2 out of the image forming apparatus main body 1. An accommodation state of the paper feeding cassette 2 in the image forming apparatus main body 1 may become unstable, and the paper P picked up by the pickup roller 21 does not stably enter the paper feed path 8, thereby generating a paper jam. The external appearance of the image forming apparatus may be degraded, for example, with in incomplete engagement of the image forming apparatus main body 1 and the paper feeding cassette 2.

According to an exemplary embodiment, by using the sliding motion of the handle member 130 with respect to the image forming apparatus main body 1, the separation member 140 may be switched between the normal position and the separation position to separate the driven roller 112 from the driving roller 111, without the elastic force of the elastic member 113 acting on the paper feeding cassette 2. Thus, installation stability of the paper feeding cassette 2 in the image forming apparatus main body 1 may be secured, and the quality of the external appearance of the image forming apparatus may be improved.

The separation member 140 at the normal position does not contact the driven roller 112. Accordingly, the pressing state of the driven roller 112 against the driving roller 111 may be stably maintained so that reliability in the paper transfer may be improved.

When the separation member 140 is excessively rotated in the direction D1 over the separation position or in the direction D2 over the normal position, a support portion (not shown) of the holder 120 supporting the driven roller 112 may be damaged. The first and second connection portions 142 and 131 may be damaged as an impact may be applied to the first and second connection portions 142 and 131.

Figure 8:
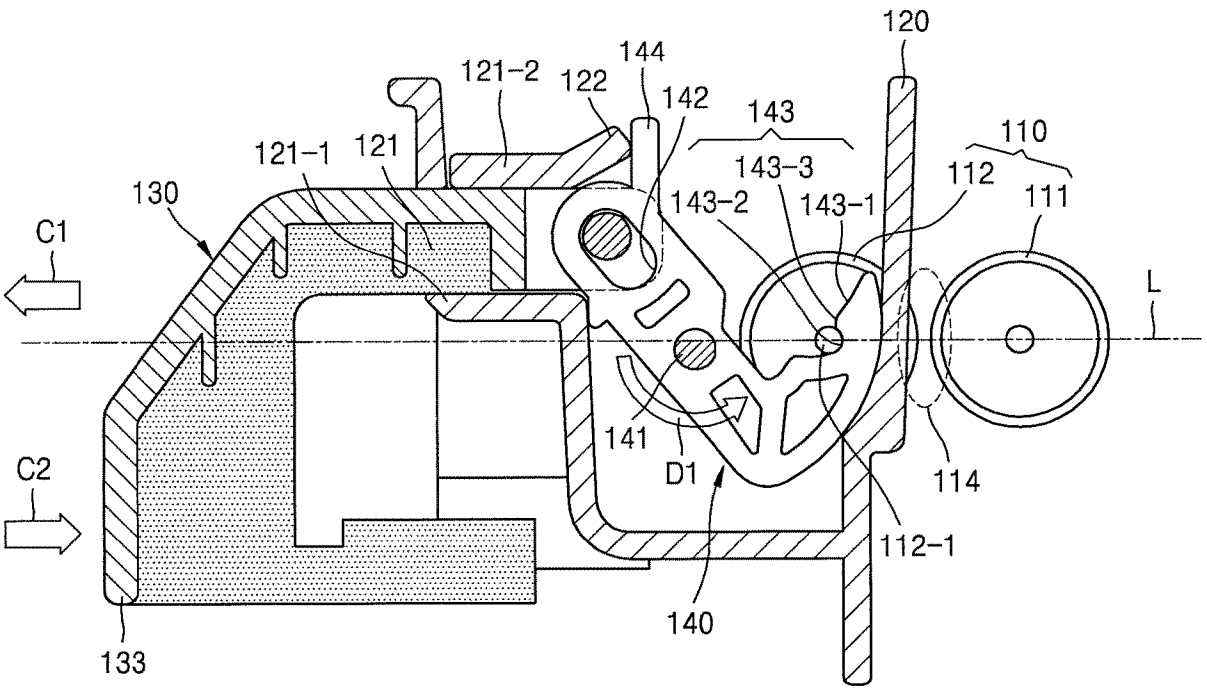
FIG. 8 illustrates a roller separation device having a first stopper according to an exemplary embodiment.

FIG. 8 is a cross-sectional view of a roller separation device having a first stopper 144 according to an exemplary embodiment. Referring to FIG. 8, the roller separation device according to an exemplary embodiment may include the first stopper 144 that prevents the separation member 140 from excessively rotating over the separation position. For example, the first stopper 144 may be provided on the separation member 140. When the separation member 140 is located at the separation position, the first stopper 144 contacts the holder 120. Accordingly, the separation member 140 may be maintained at the separation position without further pivoting in the direction D1. An excessive rotation prevention portion 122 that contacts the first stopper 144 when the separation member 140 may be located at the separation position may be provided on the holder 120. In an example, the excessive rotation prevention portion 122 may be provided at an end portion of the upper rail 121-2 forming the rail 121. The scope of the present inventive concept is not limited by the number of the first stoppers 144. For example, only one first stopper 144 may be used or three or more first stoppers 144 may be used.

Figure 9:
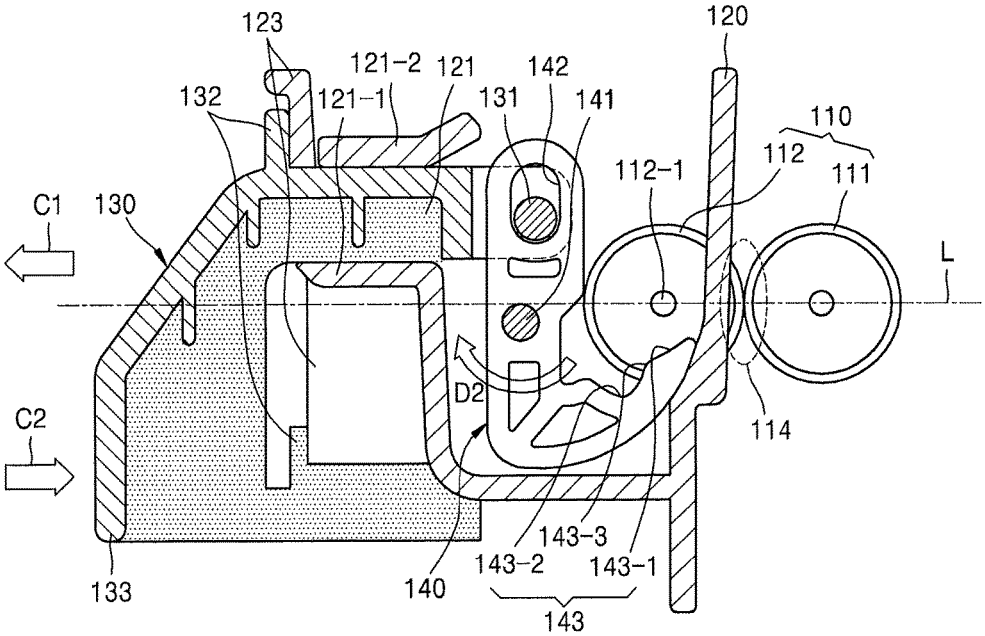
FIG. 9 illustrates a roller separation device having a second stopper according to an exemplary embodiment.

FIG. 9 is a cross-sectional view of a roller separation device having a second stopper 132 according to an exemplary embodiment. Referring to FIG. 9, the roller separation device according to an exemplary embodiment may include a second stopper 132 that stops the sliding of the handle member 130 when the separation member 140 is located at the normal position. For example, the second stopper 132 may be provided on the handle member 130. When the separation member 140 is located at the normal position, the second stopper 132 contacts the holder 120. Accordingly, the handle member 130 does not slide over the first position, and the separation member 140 no longer pivots in the direction D2 and is maintained at the normal position. A movement prevention portion 123 that contacts the second stopper 132 when the separation member 140 is located at the normal position may be provided on the holder 120.

Figure 10:
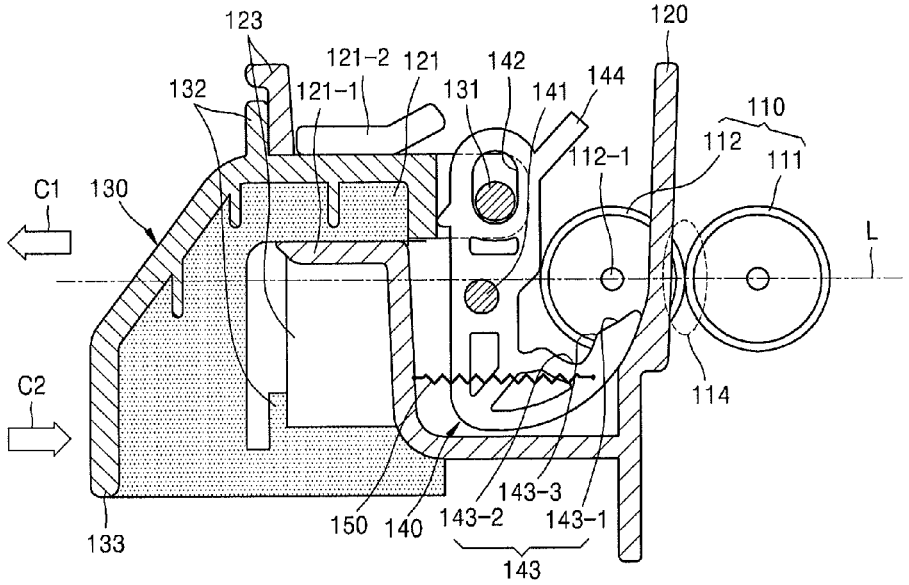
FIG. 10 illustrates a roller separation device having a return spring according to an exemplary embodiment.

FIG. 10 is a cross-sectional view of a roller separation device having a return spring 150 according to an exemplary embodiment. Referring to FIG. 10, the return spring 150 provides an elastic force to the separation member 140 in a direction to return to the normal position. For example, the return spring 150 may be a tension coil spring having one end portion and the other end portion respectively supported on the separation member 140 and the holder 120. Although it is not illustrated, the return spring 150 may have a variety of shapes such as a compression coil spring, a torsion spring, a leaf spring, etc.

As the roller separation device according to an exemplary embodiment includes the return spring 150, the separation member 140 may be maintained in the normal position by being separated from the driven roller 112. Accordingly, interference in the rotation of the driven roller 112 or generation of noise as the separation member 140 located at the normal position moves and contacts the driven roller 112 may be prevented. Since the pressing state of the driven roller 112 and the driving roller 111 may be stably maintained, stability of the paper transfer may be improved. When the driven roller 112 is pressed again against the driving roller 111 after a jammed paper is removed, sliding of the handle member 130 is facilitated and thus the handle member 130 may slide with a relatively small force to return the separation member 140 to the normal position.

Figure 11:
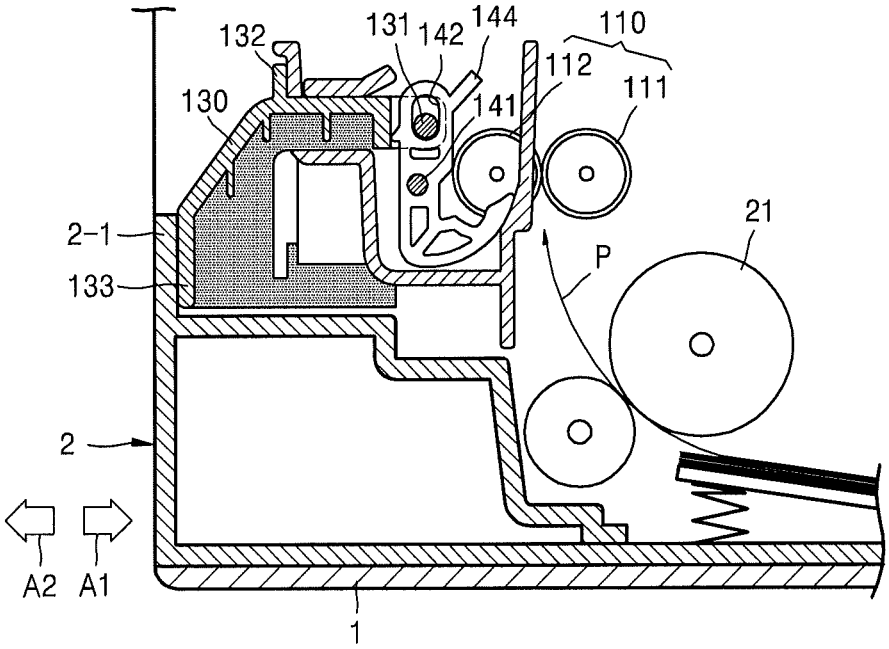
FIGS. 11 and 12 illustrate a roller separation device according to an exemplary embodiment.
Figure 12:
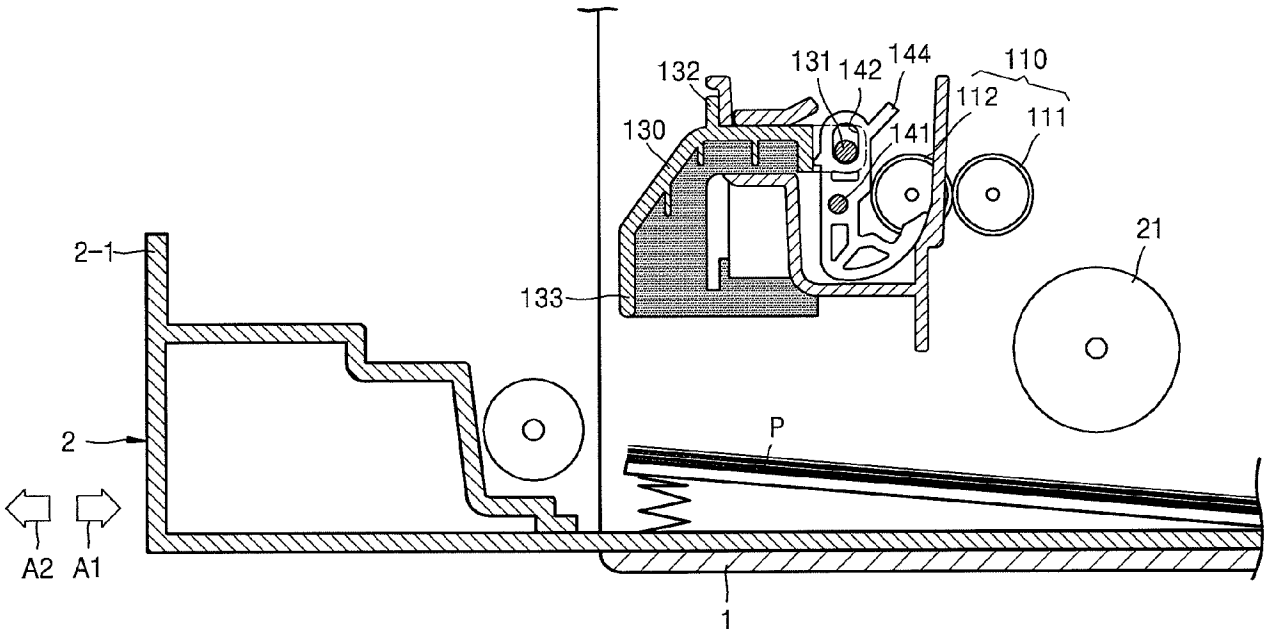

FIGS. 11 and 12 are side views of a roller separation device according to an exemplary embodiment. Referring to FIGS. 11 and 12, when the paper feeding cassette 2 is inserted in the image forming apparatus main body 1, the handle member 130 is pushed by the paper feeding cassette 2 to slide from the second position illustrated in FIG. 5 to the first position illustrated in FIG. 4. To this end, a pressing portion 2-1 that pushes the handle member 130 to slide when the paper feeding cassette 2 is pushed into the image forming apparatus main body 1 is provided on the paper feeding cassette 2.

As illustrated in FIG. 11, when the paper feeding cassette 2 is inserted in the image forming apparatus main body 1, the pressing portion 2-1 blocks the grip portion 133 of the handle member 130. Accordingly, when the paper feeding cassette 2 is inserted in the image forming apparatus main body 1, the handle member 130 is not able to slide from the first position to the second position.

When a paper jam occurs, the paper feeding cassette 2 is pulled from the image forming apparatus main body 1 in the direction A2 as illustrated in FIG. 12, the grip portion 133 of the handle member 130 is exposed to the outside. As the handle member 130 is pulled in the direction C1 in FIG. 5 by holding the grip portion 133 to slide to the second position, the separation member 140 may pivot to the separation position.

When the jammed paper is removed by pulling the handle member 130 from the image forming apparatus main body 1 as illustrated in FIG. 5 and then printing is performed in a state in which the handle member 130 is not returned to the state illustrated in FIG. 4, since the driven roller 112 and the driving roller 111 are separated from each other, the paper P is not transferred and a print error may be generated.

According to an exemplary embodiment, when the paper feeding cassette 2 is inserted into the image forming apparatus main body 1, the pressing portion 2-1 pushes the handle member 130 to slide to the first position. The separation member 140 may be returned to the normal position by the operation of inserting the paper feeding cassette 2. According to the above structure, without intentionally returning the handle member 130 to the first position, the handle member 130 is returned to the first position by the operation of inserting the paper feeding cassette 2 and thus user convenience may be improved. An error that a print job is performed in a state in which the driven roller 112 is separated from the driving roller 111 may be prevented.

Since the separation member 140 is separated from the driven roller 112 in a state in which the driven roller 112 is pressed against the driving roller 111, the elastic force of the elastic member 113 does not act on the separation member 140. Accordingly, even when the pressing portion 2-1 of the paper feeding cassette 2 pushes the handle member 130, the elastic force of the elastic member 113 does not affect the paper feeding cassette 2 and accommodation stability of the paper feeding cassette 2 in the image forming apparatus main body 1 may be maintained.

As illustrated in FIG. 10, when the return spring 150 is used, the paper feeding cassette 2 may be inserted into the image forming apparatus main body 1 with a relatively small force while returning the handle member 130 to the first position.

The handle member 130 may be moved to the first and second positions in engagement with the inserting/pulling operations of the paper feeding cassette 2 with respect to the image forming apparatus main body 1. By the operation of pulling the paper feeding cassette 2 from the image forming apparatus main body 1, the handle member 130 may be moved from the first position to the second position and thus the driven roller 112 may be separated from the driving roller 111. By the operation of inserting the paper feeding cassette 2 back into the image forming apparatus main body 1, the handle member 130 may be returned to the first position and thus the driven roller 112 may contact the driving roller 111.

Figure 13:
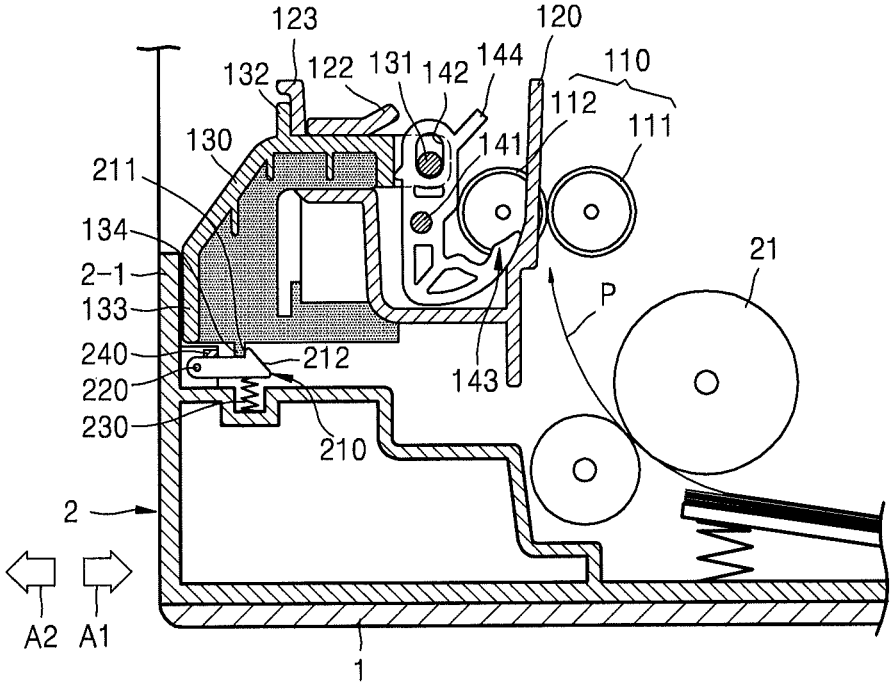
FIG. 13 illustrates a roller separation device according to an exemplary embodiment, illustrating a state in which a handle member is located at a first position.
Figure 14:
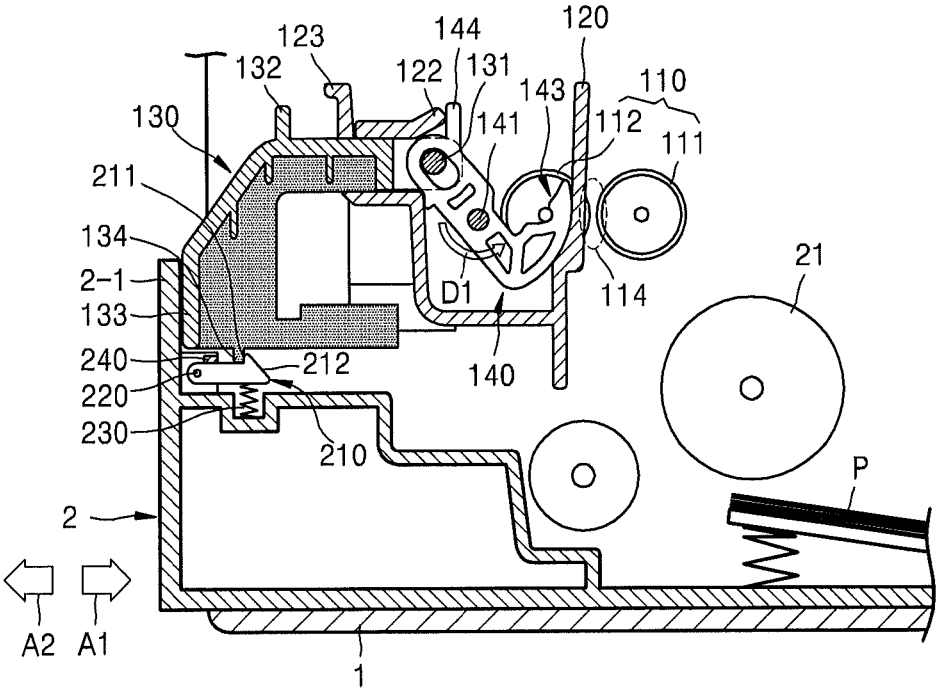
FIG. 14 illustrates an exemplary roller separation device of FIG. 13, illustrating a state in which the handle member is located at a second position.
Figure 15:
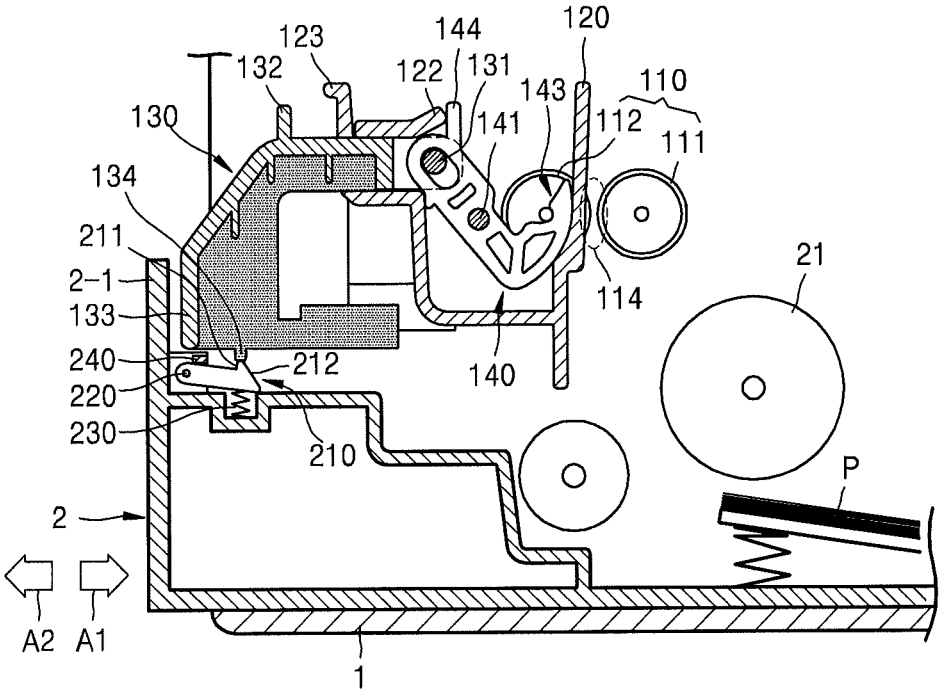
FIG. 15 illustrates an exemplary roller separation device of FIG. 13, illustrating a state in which a removal lever is located at a removal position.
Figure 16:
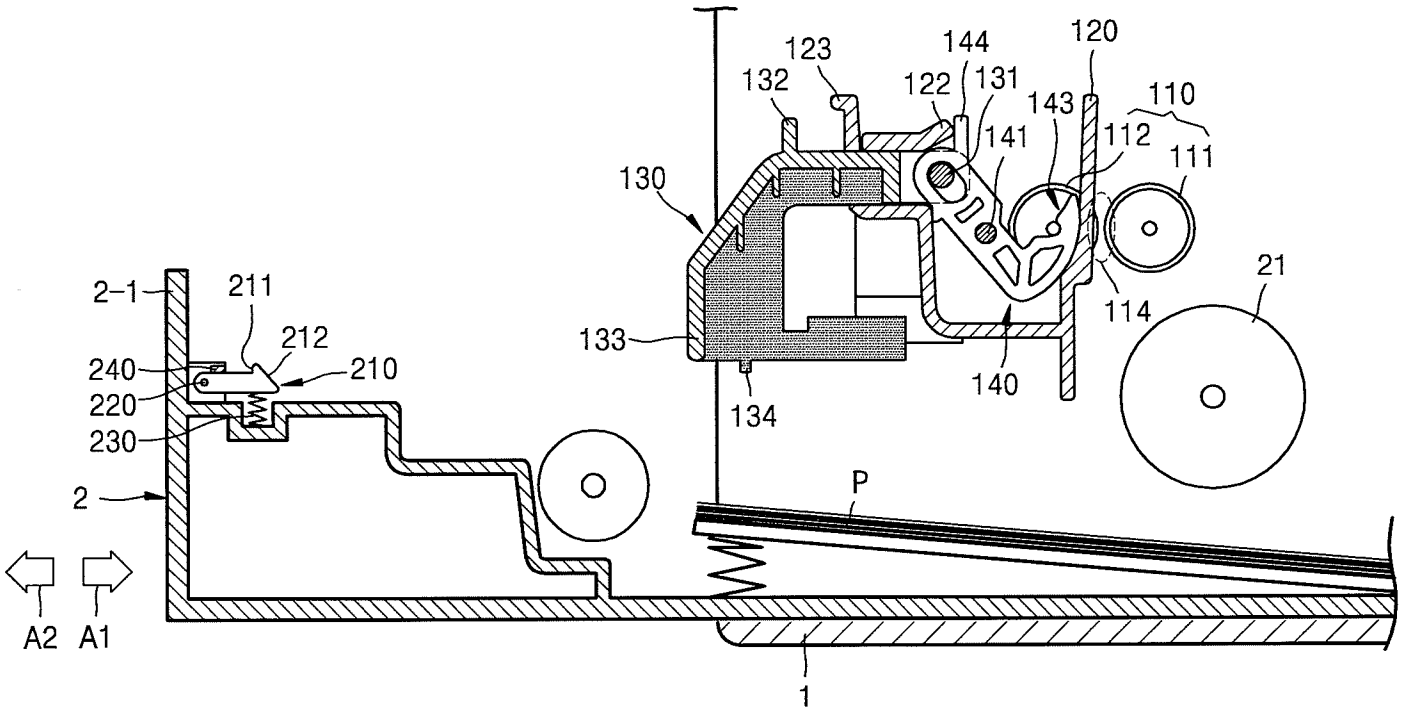
FIG. 16 illustrates an exemplary roller separation device of FIG. 13, illustrating a state in which a paper feeding cassette is pulled from a main body.

FIG. 13 is a schematic cross-sectional view of a roller separation device according to an exemplary embodiment, illustrating a state in which the handle member 130 is located at the first position. FIG. 14 is a schematic cross-sectional view of the roller separation device of FIG. 13, illustrating a state in which the handle member 130 is located at the second position. FIG. 15 is a schematic cross-sectional view of the roller separation device of FIG. 13, illustrating a state in which a removal lever 210 is located at a removal position. FIG. 16 is a schematic cross-sectional view of the roller separation device of FIG. 13, illustrating a state in which the paper feeding cassette 2 is pulled from the image forming apparatus main body 1.

Referring to FIG. 13, a removal lever 210 may be provided on the paper feeding cassette 2. A first catch portion 134 may be provided on the handle member 130. A second catch portion 211 may be provided on the removal lever 210. When the handle member 130 is located at the first position, the second catch portion 211 is caught by the first catch portion 134.

Referring to FIG. 14, when the handle member 130 is located at the second position, the second catch portion 211 is released from the first catch portion 134. Accordingly, even when the handle member 130 is located at the second position, the paper feeding cassette 2 may be pulled from the image forming apparatus main body 1 to a position where loading of the paper P is possible.

The removal lever 210 may be switched from a catch position, to move the handle member 130 from the first position to the second position, where the second catch portion 211 is caught by the first catch portion 134 to the removal position where the second catch portion 211 is released from the first catch portion 134. In an example, the removal lever 210 is installed on the paper feeding cassette 2 to be capable of pivoting around a pivot shaft 220. A catch spring 230 is applied an elastic force in a direction in which the removal lever 210 is switched to the catch position. A variety of elastic members, for example, a compression coil spring, a torsion coil spring, etc., may be used as the catch spring 230.

As illustrated in FIG. 13, when the paper feeding cassette 2 is pulled in the direction A2 in a state in which the removal lever 210 is located at the catch position, the handle member 130 is moved from the first position to the second position and the separation member 140 pivots to the separation position. As illustrated in FIG. 14, when the handle member 130 arrives at the second position, the first stopper 144 is restricted by the excessive rotation prevention portion 122 and the handle member 130 is stopped. In this state, the separation member 140 is located at the separation position and the driven roller 112 is separated from the driving roller 111. The amount of an elastic force of the catch spring 230 is determined considering the elastic force of the elastic member 113 that presses the driven roller 112 toward the driving roller 111 such that a catch state of the first and second catch portions 134 and 211 is maintained until the handle member 130 arrives at the second position.

When the paper feeding cassette 2 is pulled in the direction A2, the removal lever 210 pivots in a direction opposite to the direction in which the elastic force of the catch spring 230 is applied. The removal lever 210 pivots to the removal position where the second catch portion 211 is removed from the first catch portion 134, as illustrated in FIG. 15, the paper feeding cassette 2 is in a state of being further pulled in the direction A2 for paper loading, for example. When the paper feeding cassette 2 is further pulled in the direction A2, as illustrated in FIG. 16, the removal lever 210 is returned to the catch position by the elastic force of the catch spring 230. A blocking portion 240 to block the removal member 210 from further pivoting beyond the catch position may be provided on the paper feeding cassette 2. Accordingly, the paper feeding cassette 2 may be pulled from the image forming apparatus main body 1, as illustrated in FIG. 16 without interference between the removal member 210 and the handle member 130.

In the state illustrated in FIG. 16, when the paper feeding cassette 2 is pushed in a direction indicated by an arrow A1 (insertion direction), an interference portion 212 having a shape of an inclined surface and provided at a leading end portion of the removal lever 210 interferes with the first catch portion 134 and, as illustrated in FIG. 15, the removal lever 210 pivots in a direction so that the removal lever 210 is switched to the removal position. When the paper feeding cassette 2 is further pushed in the direction A1, the interference between the interference portion 212 and the first catch portion 134 ends and then the removal lever 210 is returned to the catch position as illustrated in FIG. 14. In this state, the pressing portion 2-1 of the paper feeding cassette 2 contacts the handle member 130, for example, the grip portion 133, and the handle member 130 pushed by the paper feeding cassette 2 is moved to the first position. When the second stopper 132 contacts the movement prevention portion 123, the handle member 130 is located at the first position and the separation member 140 is located at a normal position. The driven roller 112 may be pressed against the driving roller 111 by the elastic force of the elastic member 113.

Since the driven roller 112 and the driving roller 111 may contact/be separated from each other in engagement with the pulling/inserting operations of the paper feeding cassette 2, user convenience may be improved. Since the elastic force of the elastic member 113 does not act on the paper feeding cassette 2 in a state in which the paper feeding cassette 2 is completely inserted in the image forming apparatus main body 1, the insertion position of the paper feeding cassette 2 is not affected by the elastic force of the elastic member 113.

Figure 17:
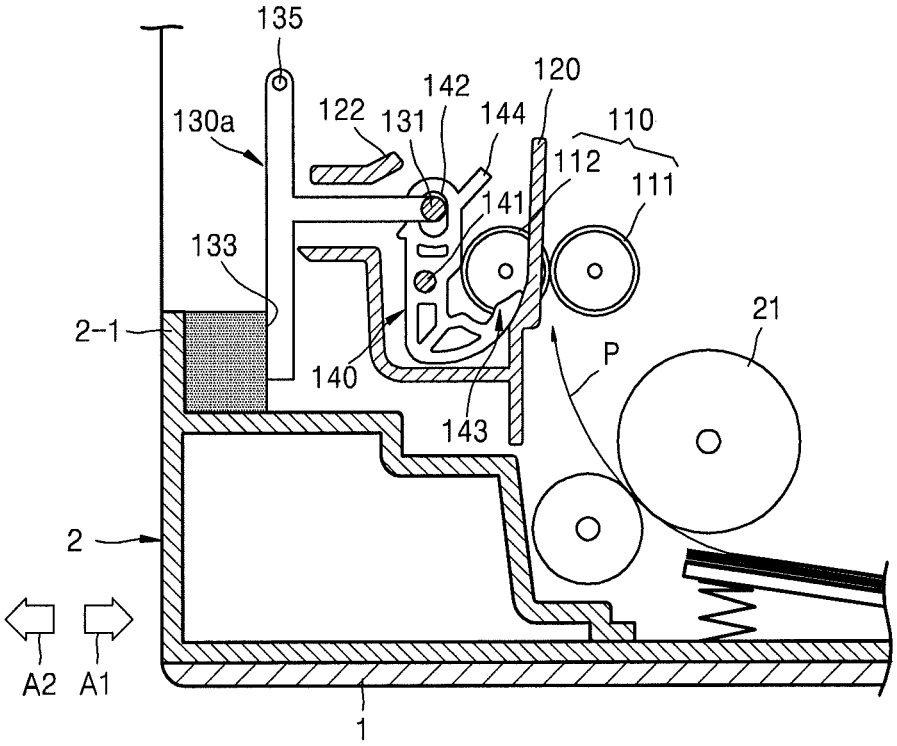
FIG. 17 illustrates a roller separation device according to an exemplary embodiment, illustrating a state in which the handle member is located at a first position.
Figure 18:
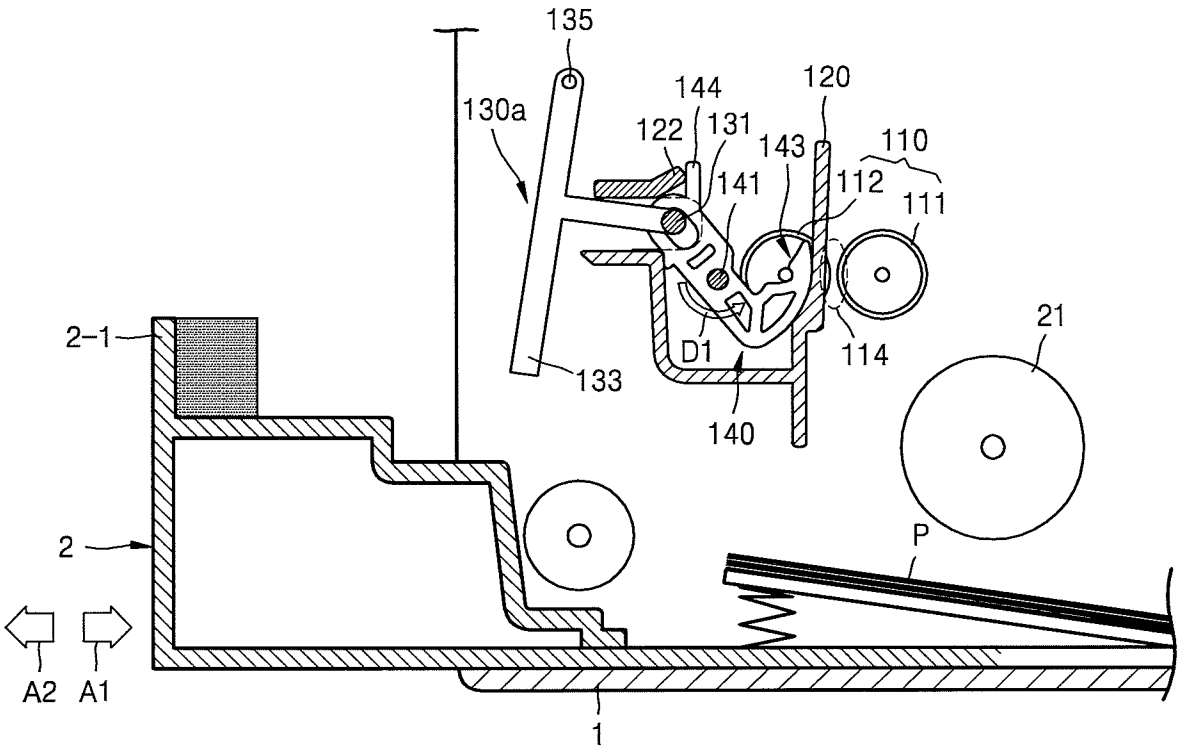
FIG. 18 illustrates an exemplary roller separation device of FIG. 17, illustrating a state in which the handle member is located at the second position.

Although in the above-described exemplary embodiments the handle member 130 that slides to switch the separation member 140 between the normal position and the separation position is used, the scope of the present inventive concept is not limited thereto. FIG. 17 is a schematic cross-sectional view of a roller separation device according to an exemplary embodiment, illustrating a state in which a handle member 130*a* is located at the first position. FIG. 18 is a schematic cross-sectional view of the roller separation device of FIG. 17, illustrating a state in which the handle member 130*a* is located at the second position.

Referring to FIG. 17, the handle member 130*a* may be provided on the image forming apparatus main body 1 to be capable of pivoting around a pivot shaft 135. The handle member 130*a* may include the second connection portion 131 connected to the first connection portion 142 of the separation member 140 and the grip portion 133 for pivoting the handle member 130*a*. The pressing portion 2-1 that switches the handle member 130*a* to the first position by pushing the grip portion 133 of the handle member 130*a* when the paper feeding cassette 2 is installed on the image forming apparatus main body 1 is provided on the paper feeding cassette 2. In a state in which the paper feeding cassette 2 is inserted in the image forming apparatus main body 1, the pressing portion 2-1 covers the grip portion 133 so that the grip portion 133 is not exposed to the outside.

As illustrated in FIG. 18, when the paper feeding cassette 2 is pulled from the image forming apparatus main body 1 in the direction A2, the grip portion 133 may be exposed to the outside. When the grip portion 133 is pulled, the handle member 130*a* rotates to be switched to the second position and accordingly the separation member 140 pivots to the separation position. The driven roller 112 may be separated from the driving roller 111 by the separation member 140.

When the paper feeding cassette 2 is pushed in the direction A1, the pressing portion 2-1 pushes the grip portion 133 so that the handle member 130*a* is returned to the first position. The separation member 140 is returned to the normal position and the driven roller 112 and the driving roller 111 are contacted with each other by the elastic force of the elastic member 113.

Figure 19:
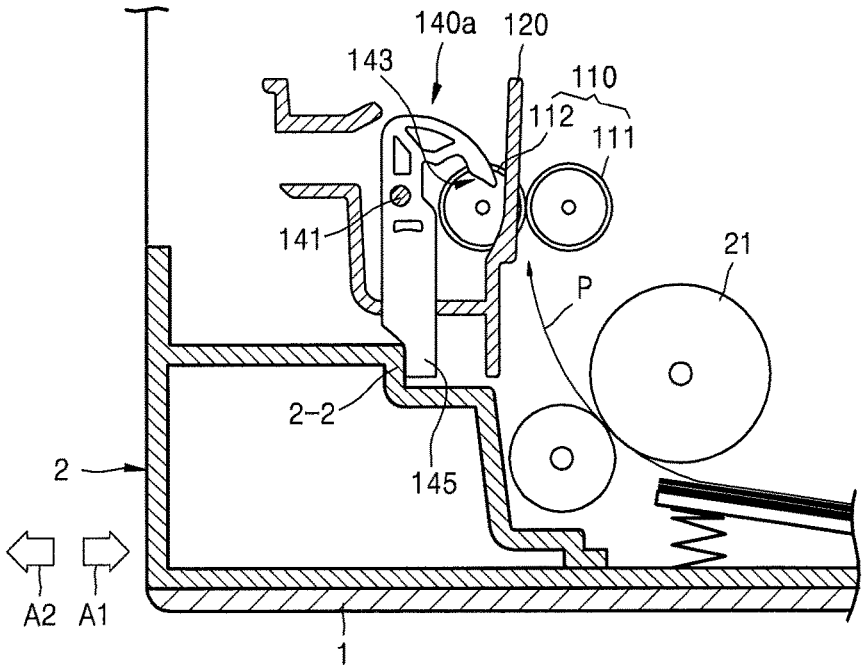
FIG. 19 illustrates a roller separation device according to an exemplary embodiment, illustrating a state in which the lever member is located at a normal position.
Figure 20:
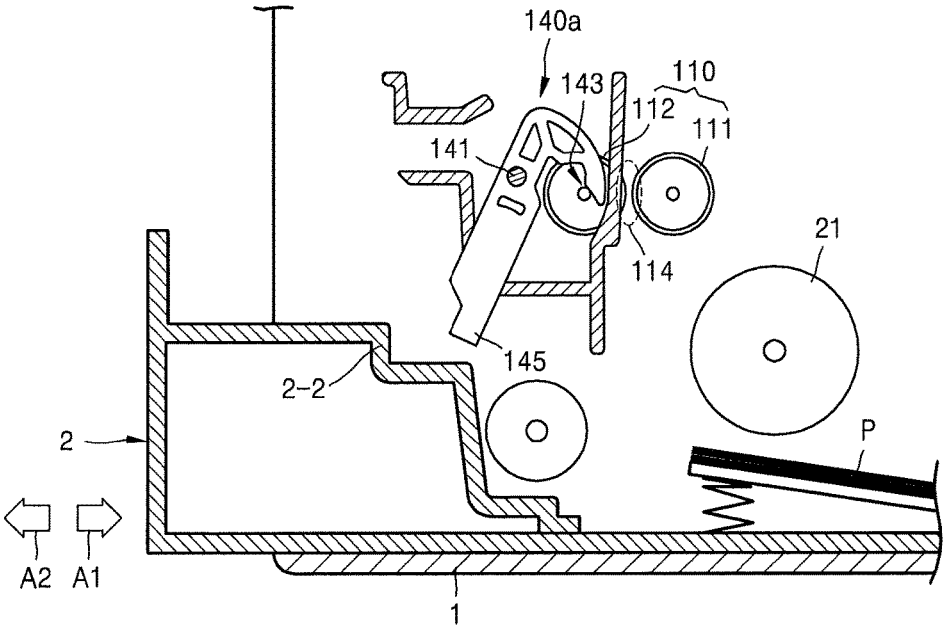
FIG. 20 illustrates a roller separation device of FIG. 19, illustrating a state in which the lever member is located at a separation position.

The handle member 130 or 130*a* may be formed integrally with the separation lever 140. FIG. 19 is a schematic cross-sectional view of a roller separation device according to an exemplary embodiment, illustrating a state in which a separation member 140*a* is located at a normal position. FIG. 20 is a schematic cross-sectional view of the roller separation device of FIG. 19, illustrating a state in which the separation member 140*a* is located at a separation position.

Referring to FIGS. 19 and 20, the separation member 140*a* may be substantially the same as the separation member 140 of FIGS. 4 to 10, except that a grip portion 145 is provided to switch the separation member 140*a* from the normal position to the separation position and the first connection portion 142 is not provided. The grip portion 145 may be located at the opposite side of the hook portion 143 with respect to the pivot shaft 141.

The pressing portion 2-1 that switches the separation member 140*a* from the separation position to the normal position by pushing the grip portion 145 of the separation member 140*a* when the paper feeding cassette 2 is inserted in the image forming apparatus main body 1, is provided on the paper feeding cassette 2. When the paper feeding cassette 2 is inserted in the image forming apparatus main body 1, the grip portion 145 is covered by the paper feeding cassette 2 so as not to be exposed to the outside.

As illustrated in FIG. 20, when the paper feeding cassette 2 is pulled from the image forming apparatus main body 1 in the direction A2, the grip portion 145 is exposed to the outside. When the grip portion 145 is pulled, the separation member 140*a* rotates to be switched from the normal position to the separation position. Accordingly, the driven roller 112 is separated from the driving roller 111.

When the paper feeding cassette 2 is pushed in the direction A1, the pressing portion 2-1 pushes the grip portion 145 so that the separation member 140*a* is returned to the normal position. Then, the driven roller 112 and the driving roller 111 are contacted with each other by the elastic force of the elastic member 113.

Although in the above-described exemplary embodiment the image forming apparatus employing the print unit 3 of an electrophotographic type is described, the scope of the present inventive concept is not limited thereto. The roller separation device of the above-described exemplary embodiment may be applied to an image forming apparatus employing various printing methods such as an inkjet method, a thermal transfer method, etc.

It should be understood that the exemplary embodiments described herein should be considered in a descriptive sense only and not for purposes of limitation. Descriptions of features or aspects within each embodiment should typically be considered as available for other similar features or aspects in other embodiments.

While one or more embodiments of the present inventive concept have been described with reference to the figures, it will be understood by those of ordinary skill in the art that various changes in form and details may be made therein without departing from the spirit and scope of the present inventive concept as defined by the following claims.

What is claimed is:

1. An image forming apparatus comprising:

a main body having a printer;

a first paper feeder configured to contain a print paper and insertable in or pullable from the main body;

a feed roller in the main body and configured to feed the print paper from the first paper feeder to the printer, the feed roller comprising a driven roller and a driving roller capable of contacting each other;

an elastic member applying an elastic force to the driven roller in a direction for the driven roller to contact the driving roller;

a handle member in the main body and movable between a first position and a second position; and a separation member connected to the handle member and switchable from a normal position not in contact with the driven roller when the driven roller is in contact with the driving roller to a separation position in contact with the driven roller and separating the driven roller from the driving roller by pulling the driven roller as the handle member moves from the first position to the second position, wherein the handle member is provided in the main body to be slidable to the first position and the second position, and the separation member is provided in the main body to be pivotable to the separation position and the normal position, and wherein the separation member comprises a pivot shaft, a pull portion to contact the rotation shaft and separate the driven roller from the driving roller as the separation member pivots from the normal position to the separation position, and an accommodation portion on which a rotation shaft of the driven roller is accommodated at the separation position.

2. The image forming apparatus of claim 1, wherein the pull portion comprises a first end portion and a second end portion having a pivot radius from the pivot shaft that is smaller than that of the first end portion, and a boundary portion having a pivot radius from the pivot shaft that is larger than that of the second end portion is provided between the pull portion and the accommodation portion.

3. The image forming apparatus of claim 1, wherein the pivot shaft of the separation member is located around a line connecting centers of the driven roller and the driving roller.

4. The image forming apparatus of claim 3, wherein an acting line of the elastic force of the elastic member and the pivot shaft are located on the line.

5. The image forming apparatus of claim 1, wherein, when the separation member pivots from the normal position to the separation position, an angle between the pull portion and a line perpendicular to a line connecting centers of the driven roller and the driving roller is equal to or less than 45°.

6. The image forming apparatus of claim 1, further comprising a return spring that applies an elastic force to the separation member in a direction in which the separation member is maintained at the normal position.

7. The image forming apparatus of claim 1, further comprising:

a first stopper provided on the separation member; and an excessive rotation prevention portion provided in the main body and contacted by the first stopper when the separation member is located at the separation position.

8. The image forming apparatus of claim 1, further comprising:

a second stopper provided on the handle member; and a movement prevention portion provided in the main body and contacted by the second stopper when the separation member is located at the normal position.

9. The image forming apparatus of claim 1, wherein the handle member is moved from the second position to the first position by an operation of inserting the first paper feeder into the main body, and a pressing portion pushing the handle member located at the second position toward the first position when the first paper feed unit is inserted into the main body is provided on the first paper feeder.

10. The image forming apparatus of claim 9, wherein a grip portion is provided on the handle member, the pressing portion covers the grip portion in a state in which the first paper feeder is inserted in the main body, and the grip portion is exposed to the outside when the first paper feeder is pulled from the main body.

11. The image forming apparatus of claim 1, wherein the handle member is moved to the first position and the second position according to the inserting and pulling operations of the first paper feeder.

12. The image forming apparatus of claim 1, wherein the handle member pivots to the first position and the second position.

13. The image forming apparatus of claim 1, wherein the handle member is integrally formed with the separation member.

14. A roller separation device configured to separate a driven roller from a driving roller, the roller separation device comprising:

a holder including an excessive rotation prevention portion and supporting the driven roller;

an elastic member pressing the driven roller in a direction in which the driven roller contacts the driving roller;

a handle member supported on the holder and slidable between a first position and a second position; and a separation member connected to the handle member, supported on the holder and configured to pivot, and thereby rotates to a normal position not in contact with the driven roller when the driven roller is in contact with the driving roller and to a separation position in contact with the driven roller to separate the driven roller from the driving roller by pulling the driven roller as the handle member moves from the first position to the second position, and having an excessive rotation prevented by the excessive rotation prevention portion of the holder.

15. The roller separation device of claim 14, wherein the separation member comprises a pivot shaft, a pull portion to contact the rotation shaft and separate the driven roller from the driving roller as the separation member pivots from the normal position to the separation position, and an accommodation portion on which a rotation shaft of the driven roller is accommodated at the separation position, the pull portion comprises a first end portion and a second end portion having a pivot radius from the pivot shaft that is smaller than that of the first end portion, and a boundary portion having a pivot radius from the pivot shaft that is larger than that of the second end portion is provided between the pull portion and the accommodation portion.

16. The roller separation device of claim 15, wherein the pivot shaft of the separation member is located around a line connecting centers of the driven roller and the driving roller.

17. The roller separation device of claim 14, further comprising a return spring that applies an elastic force to the separation member in a direction in which the separation member is maintained at the normal position.

18. The roller separation device of claim 14, further comprising:

a first stopper provided on the separation member that contacts the excessive rotation prevention portion when the separation member is located at the separation position;

a second stopper provided on the handle member; and a movement prevention portion provided in the holder and contacted by the second stopper when the separation member is located at the normal position.

* * * * *